United States Patent [19]

Confalonieri

[11] Patent Number: 4,946,031

[45] Date of Patent: Aug. 7, 1990

[54] HOLDER PARTICULARLY FOR A SHEET BLOCK

[75] Inventor: Giulio Confalonieri, Milan, Italy

[73] Assignee: Nava Milano S.P.A., Milan, Italy

[21] Appl. No.: 465,820

[22] Filed: Jan. 16, 1990

[30] Foreign Application Priority Data

Jan. 25, 1989 [IT] Italy ..... 20475/89[U]

[51] Int. Cl.[5] ..... B65D 85/00

[52] U.S. Cl. ..... 206/38; 206/215; 206/555

[58] Field of Search ..... 206/215, 39.5, 39.6, 206/38, 555

[56] References Cited

U.S. PATENT DOCUMENTS

| | | | |
|---|---|---|---|
| 646,726 | 4/1900 | Chelimer | 206/39.6 |
| 1,537,641 | 5/1925 | Kristofek | 206/39.5 |
| 2,013,281 | 9/1935 | McCalla | 206/38 X |
| 2,981,408 | 4/1961 | Gamble | 206/555 |
| 3,092,379 | 6/1963 | Collier | 206/555 |
| 3,421,658 | 1/1969 | Cooksey | 206/39.5 |
| 4,305,497 | 12/1981 | Pacilio | 206/38 X |

FOREIGN PATENT DOCUMENTS

| | | | |
|---|---|---|---|
| 275369 | 6/1930 | Italy | 206/38 |
| 709688 | 6/1954 | United Kingdom | 206/555 |

*Primary Examiner*—William Price

*Attorney, Agent, or Firm*—Guido Modiano; Albert Josif

[57] ABSTRACT

This holder is particularly intended for a sheet block and comprises a tray-shaped body having a missing front edge and defining a holding seat for a stack of sheets. The tray-shaped body has the rear edge thereof which is inclined forward so that the front edges of the stack sheets are offset to each other, and is slidably supported by a base body upwardly closed by the tray-shaped body. The base body has front and rear edges which have a forward inclination corresponding to the inclination of the rear edge of the tray-shaped body and defines a plurality of compartments.

6 Claims, 2 Drawing Sheets

HOLDER PARTICULARLY FOR A SHEET BLOCK

BACKGROUND OF THE INVENTION

The present invention relates to a holder particularly for a sheet block.

As is known, trays are currently commercially available which internally define a seat in which a stack or block of individually extractable sheets is insertable.

Known solutions, despite being used extensively, generally have the disadvantage of not allowing the easy extraction of the sheet and furthermore have a functionality which is limited exclusively to accommodating sheets.

SUMMARY OF THE INVENTION

The aim of the invention is indeed to provide a holder which is specifically studied for blocks or stacks of sheets which besides considerably facilitating the removal of the individual sheets also allows a rational arrangement of typical stationary items such as pencils, erasers, clips and the like.

Within the scope of the above aim, a particular object of the invention is to provide a holder which despite having improved functionality preserves a very simple structure and allows a reduction in bulk.

Another object of the present invention is to provide a holder which is particularly practical and functional and which is furthermore easily obtainable starting from commonly commercially available elements and materials.

The above aim, as well as the objects mentioned and others which will become apparent hereinafter, are achieved by a holder particularly for a sheet block, as defined in claim 1.

BRIEF DESCRIPTION OF THE DRAWINGS

The characteristics and advantages will become apparent from the detailed description of a holder particularly for a sheet block, illustrated only by way of non-limitative example in the accompanying drawings, wherein.

DESCRIPTION OF THE PREFERRED EMBODIMENTS

Figures 1, 2:
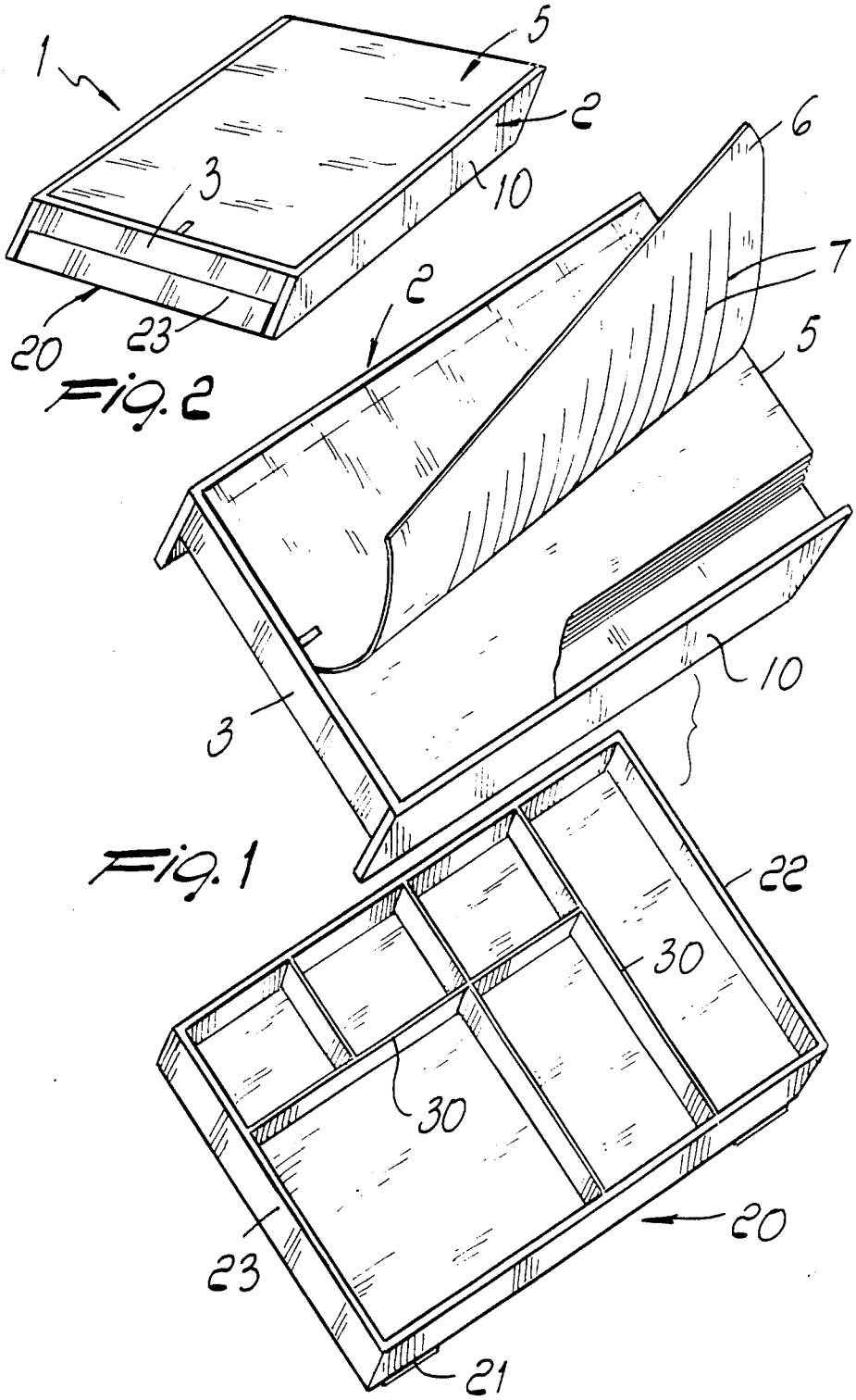
FIG. 1 is a schematic exploded perspective view of the holder for a sheet block, with the sheet block partially sectioned.
FIG. 2 is a perspective view of the holder.

With reference to the above figures, the holder particularly for a sheet block according to the invention, generally indicated by the reference numeral 1, comprises a tray-shaped body 2 which advantageously has a substantially rectangular configuration and from which one edge, generally the front edge, is missing.

The rear edge, indicated at 3, is preferably inclined forward along an upward direction, so that the front edges of the stack sheets are offset to each other, so as to facilitate extraction of the stack.

The stack of sheets 5 is possibly provided with a cover sheet 6 which has, on one face, a set of lines 7 which can act as guide if the cover sheet is placed below a sheet.

The body 2 furthermore defines a pair of longitudinal side walls 10 which protrude downward beyond the bottom which, together with the upper portions of the side walls 10 and of the rear edge 3, defines an accommodation seat for said stack of sheets.

The tray-shaped body 2 is slidably supported by a basin-shaped base body 20 which can be accommodated below the tray-shaped body 2 in the region delimited by the side walls 10, which in practice constitute a guiding element allowing longitudinal sliding of the tray-shaped body 2 with respect to the base body 20.

The base body 20 is provided, on its lower face, with resting feet 21 which in practice act as a friction element for resting on a plane, so as to allow sliding of the tray-shaped body, the side walls thereof extend toward the lower part by a smaller amount with respect to the height of the base body, so that said side walls do not touch the resting plane.

Figures 3, 4, 5, 6:
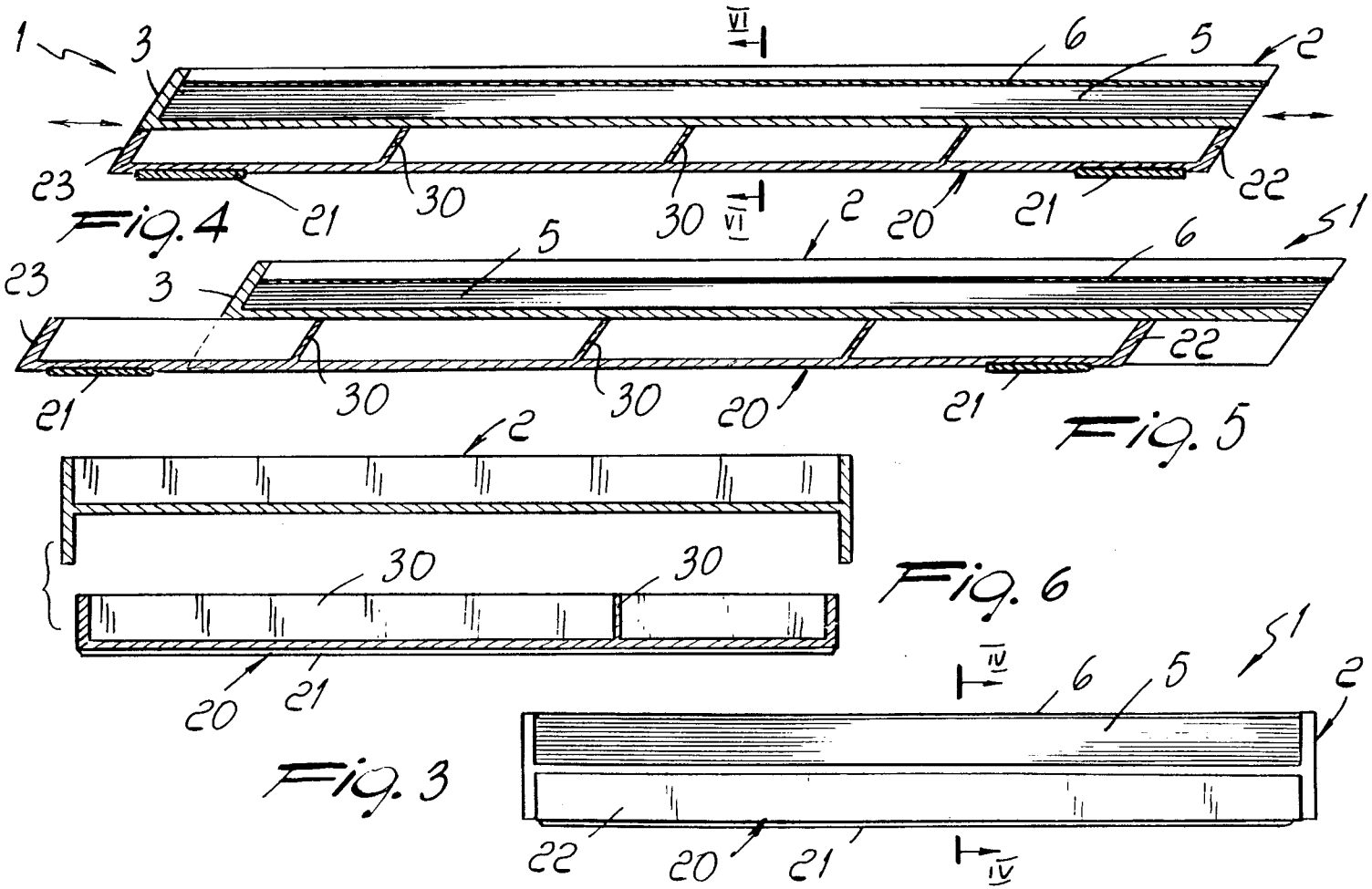
FIG. 3 is an elevation view of the holder.
FIG. 4 is a sectional view taken along the line IV—IV of FIG. 3.
FIG. 5 is a sectional view taken along the line IV—IV of FIG. 3 with the tray-shaped body shifted with respect to the base body.
FIG. 6 is an exploded sectional view taken along the line VI—VI of FIG. 4.

The base body has a front edge and a rear edge, respectively indicated at 22 and 23, the inclination whereof follows the inclination of the rear edge 3 of the tray-shaped body 2, as illustrated in FIG. 4.

Partitions, indicated at 30, are provided inside the base body and define, inside said base body 20, a plurality of compartments for accommodating various stationary items, such as for example pencils, erasers, clips and the like.

The transverse dividing walls 30 arranged parallel to the edges 22 and 23 also advantageously have the same inclination so as to facilitate the extraction of the objects they contain.

As illustrated in FIG. 5, the tray-shaped body can be caused to slide with respect to the base body, uncovering in practice some of the compartments, thus facilitating free access thereto.

From the above, it can thus be seen that the invention achieves the proposed aims and in particular the fact is stressed that a holder for a sheet block is provided which has a structure which can be defined "drawer-like" so as to act as lid for the base body which is provided with a plurality of compartments for accommodating stationary items; in this manner, two different functions, i.e. the sheet holder and a holder for miscellaneous stationery items, are combined by means of a single element.

In practice, the materials employed, as well as the dimensions and the contingent shapes, may be any according to the requirements.

I claim:

1. A holder particularly for a sheet block, comprising a tray-shaped body having a missing edge and defining a holding seat for a stack of sheets, said tray-shaped body being slidably supported by a base body which can be upwardly closed by said tray-shaped body and defines a plurality of compartments.

2. A holder according to claim 1, wherein said missing edge is a front edge, said tray-shaped body having a rear edge which is inclined forward in an upward direction to create an offset arrangement of sheets of said stack of sheets.

3. A holder, according to claim 1, wherein said tray-shaped body has downwardly protruding sides defining a guiding element allowing said tray-shaped body to slide with respect to said base body.

4. A holder, according to claim 1, wherein said base body has, on a bottom face thereof, elements for resting on a plane acting as a friction element.

5. A holder, according to claim 1, wherein said tray-shaped body has a forwardly inclined rear edge and said base body has an own front edge and an own rear edge which are inclined with an inclination which corresponds to the inclination of the rear edge of said tray-shaped body.

6. A holder, according to claim 5, wherein said base body defines a plurality of compartments which are defined by mutually intersecting walls, the walls which are parallel to said own front edge and said own rear edge having a corresponding inclination.

* * * * *